United States Patent [19]

Durning et al.

[11] 4,011,083

[45] Mar. 8, 1977

[54] SURFACE SENSITIVE SILVER HALIDE EMULSION CONTAINING A SILVER COMPLEXING AZAINDENE TO REDUCE DESENSITIZATION OF OPTICAL SENSITIZING DYE INCORPORATED THEREIN

[75] Inventors: Maurice Francis Durning, Rochester; John Edward Starr, Webster, both of N.Y.

[73] Assignee: Eastman Kodak Company, Rochester, N.Y.

[22] Filed: July 26, 1976

[21] Appl. No.: 708,818

Related U.S. Application Data

[63] Continuation of Ser. No. 531,277, Dec. 10, 1974, abandoned, which is a continuation-in-part of Ser. No. 293,963, Oct. 2, 1972, abandoned.

[52] U.S. Cl. ..... 96/109; 96/101; 96/107; 96/108; 96/130; 96/133; 96/134

[51] Int. Cl.[2] ..... G03C 1/34; G03C 1/20

[58] Field of Search ..... 96/101, 107, 109, 108, 96/133–134, 130

[56] References Cited

UNITED STATES PATENTS

| | | | |
|---|---|---|---|
| 2,444,605 | 7/1948 | Heimbach et al. | 96/109 |
| 2,886,437 | 5/1959 | Piper | 96/109 |
| 3,340,064 | 9/1967 | Riester | 96/133 |
| 3,367,778 | 2/1968 | Berriman | 96/107 |
| 3,482,981 | 12/1969 | Van Lare | 96/133 |
| 3,623,881 | 11/1971 | Fumia | 96/133 |
| 3,660,102 | 5/1972 | Riester | 96/133 |
| 3,690,891 | 9/1972 | Spence et al. | 96/101 |
| 3,706,569 | 12/1972 | Gilman et al. | 96/134 |

*Primary Examiner*—Won H. Louie, Jr.
*Attorney, Agent, or Firm*—J. G. Levitt

[57] ABSTRACT

Surface sensitive photographic low pAg silver halide emulsions and elements are provided which contain (1) a photographic infrared spectral sensitizing dye having a polarographic cathodic halfwave potential more positive than about −1.20 volts, said dye being employed in the emulsion at a concentration which results in at least about 0.3 log E desensitization of a test portion of the emulsion, when the test portion of the emulsion is coated on a support, sensitometrically exposed and developed and (2) a silver complexing azaindene in an amount effective to reduce the desensitization caused by the spectral sensitizing dye. Photographic emulsions in accordance with this invention exhibit higher speeds in the spectrally sensitized region (i.e., higher minus blue speeds) than prior art surface-sensitive emulsions. In addition, use of the emulsions in accordance with this invention permits the use of higher dye concentrations and results in emulsions having excellent keeping qualities and much lower fog levels.

14 Claims, No Drawings

SURFACE SENSITIVE SILVER HALIDE EMULSION CONTAINING A SILVER COMPLEXING AZAINDENE TO REDUCE DESENSITIZATION OF OPTICAL SENSITIZING DYE INCORPORATED THEREIN

This is a continuation of our earlier filed application Ser. No. 531,277, filed Dec. 10, 1974, now abandoned which in turn is a continuation-in-part of Ser. No. 293,963, filed Oct. 2, 1972, now abandoned.

This invention relates to novel photographic emulsions and elements, and more particularly to spectrally sensitized photographic silver halide surface-sensitive emulsions and to photographic elements containing the novel emulsions.

It is well known that photographic emulsions can be spectrally sensitized to infrared radiation. See Mees and James, *The Theory of the Photographic Process*, 3rd Edition, The MacMillan Company, 1966, pages 198 and 199. It is highly desirable that such emulsions exhibit good sensitivity to longer wavelength infrared radiation, and have high sensitivity throughout the infrared region. In addition, such emulsions should retain high sensitivity to infrared radiation on storage. The emulsions should also have high sensitivity to blue radiation.

Glafkides, *Photographic Chemistry*, Volume 2, published by Fountain Press, London, 1960, states at page 922 that desensitization by dyes is reduced by the presence of silver ions (i.e., low pAg); and points out at page 906 that the sensitivity of infrared plates is increased by hypersensitizing, such as by bathing in silver nitrate. However, Glafkides fails to suggest any means for effectively using photographic spectral sensitizing dyes in concentrations which would, without some special treatment or addenda, cause more than 0.3 log E desensitization.

Kuwabara in *Bull. Soc. Sci. Phot. of Japan*, No. 16, Dec., 1966, suggests the use of acetylenic compounds as stabilizers in silver halide emulsions containing spectral sensitizing dyes, but does not suggest that high, desensitizing concentrations of spectral sensitizing dyes could be used with such acetylenic compounds.

One object of this invention is to provide infrared sensitive photographic silver halide surface-sensitive emulsions.

Another object of this invention is to provide photographic silver halide surface-sensitive emulsions which are stable on storage.

Still another object of this invention is to provide photographic silver halide surface-sensitive emulsions which have high sensitivity to long wavelength infrared radiation.

Another object of this invention is to provide photographic silver halide surface-sensitive emulsions which retain high sensitivity to infrared radiation on storage.

A further object of this invention is to provide photographic silver halide surface-sensitive emulsions which have low fog levels.

Still another object of this invention is to provide a method of using high levels of photographic spectral sensitizing dyes in infrared sensitive photographic silver halide surface-sensitive emulsions.

An additional object of this invention is to provide photographic elements which contain novel photographic emulsions.

Other objects of this invention will be apparent from this disclosure and the appended claims.

In accordance with one embodiment of this invention, surface-sensitive photographic low pAg silver halide emulsions are provided which contain (1) at least one photographic infrared spectral sensitizing dye having a polarographic cathodic halfwave potential more positive than about −1.20 volts, said dye being employed in the emulsion at a concentration which results in at least about 0.3 log E desensitization of a test portion of the emulsion, when the test portion of the emulsion is coated on a support, sensitometrically exposed and developed; and (2) a silver complexing azaindence in an amount effective to reduce the desensitization caused by the spectral sensitizing dye.

Photographic surface-sensitive emulsions in accordance with this invention exhibit higher speeds in the spectrally sensitized region (i.e., higher minus blue speeds) than prior art emulsions containing lower concentrations of spectral sensitizing dye. In addition, use of the higher dye concentrations in accordance with the present invention results in emulsions which exhibit sensitivity to longer wavelength radiation than prior art surface-sensitive emulsions having lower dye concentrations and in addition results in emulsions which exhibit low fog levels and outstanding keeping qualities.

Generally, the surface-sensitive emulsions of this invention are those emulsions which can be made by a simple silver halide precipitation in the presence of a chemical sensitizer. Such emulsions exhibit sensitivity on the surface of the grain and are of the negative developing-out type. Preferably, the emulsions are those derived from precipitation of an alkali metal halide and a water-soluble silver salt in the presence of a peptizer and are chemically sensitized by a sulfur and/or noble-metal sensitization.

By "low pAg emulsions" we mean that the silver ion concentration in the emulsion is adjusted to from about pAg 6.0 to 8.5 and preferably from about pAg 6.5 to 7.5, pAg being defined as the negative logarithm of silver ion concentration. The pAg measurements are made using a silver billet electrode lightly electroplated with silver bromide and a silver/silver chloride saturated KCl reference electrode at 40° C.

The term "photographic infrared spectral sensitizing dye" is used herein and in the appended claims as a word of art which denotes dyes employed as spectral sensitizers in negative, surface-sensitive developing-out silver halide emulsions. Such dyes normally have a polarographic cathodic halfwave potential more positive than about −1.20 volts.

In accordance with the present invention, cathodic measurements are made with a $1 \times 10^{-4}$ molar solution of the dye in a solvent, for example, methanol which is 0.05 molar in lithium chloride. A dropping mercury electrode can be used for the cathodic measurement with the polarographic halfwave potential for the cathodic response most positive in potential designated $E_c$. A pyrolytic graphite electrode can be used for the anodic measurement with the voltammetric half-peak potential for the anodic response most negative in potential designated $E_a$. In each measurement, the reference electrode can be an aqueous silver-silver chloride (saturated potassium chloride) electrode at 20° C. Plus and minus signs are assigned to the potential values according to the IUPAC Stockholm Convention 1953. The $E_a$ and $E_c$ values so measured shall not include processes in which electron transfer is primarily the result of the presence in solution of the counter ion of a positively charged dye or other such chemical entities in solutions that are not an integral part of, or attached to, the chromophoric system of the dye. A response of lesser current magnitude preceding the primary response, such as a prewave resulting from adsorption of the electrolysis product to the electrode surface, shall be excluded from designation as $E_a$ or $E_c$.

Electrochemical measurements of this type are known in the art and are described in one or more of the following reference texts: *New Instrumental Methods in Electrochemistry*, by Delahay, Interscience Publishers, New York, New York, 1954; *Polarography*, by Kolthoff and Lingane, 2nd Edition, Interscience Publishers, New York, New York, 1952; and *Electrochemistry at Solid Electrodes*, by Adams, Marcell Dekker, Inc., New York, New York, 1969.

The useful photographic infrared spectral sensitizing dyes are the methine dyes, such as the cyanine, merocyanine, hemicyanine, oxonol and styryl dyes having a polarographic cathodic halfwave potential more positive than about −1.20 volts and having sensitivity maxima greater than about 700 nm.

The preferred cyanine dyes of the invention are represented by the following general formulas:

I.

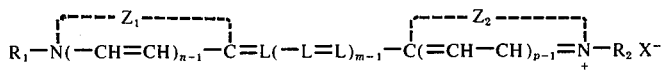

II.

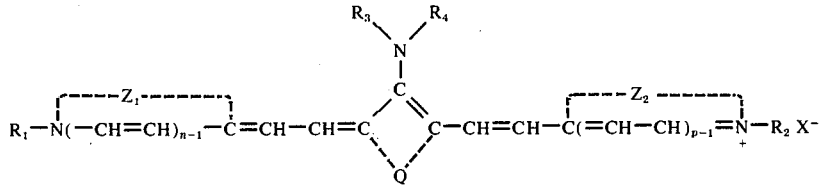

III.

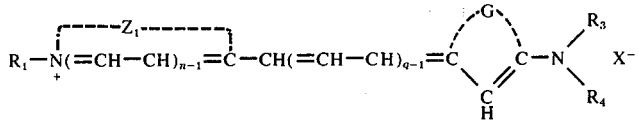

wherein $n$ and $p$ represent a positive integer of 1 or 2, m represents a positive integer of from 2 to 6 and $q$ represents a positive integer of 2 or 3. $X^-$ represents an acid anion, such as chloride, bromide, p-toluene sulfonate, methane sulfonate, methylsulfate, ethylsulfate, perchlorate, etc.; $R_1$, $R_2$, $R_3$ and $R_4$ each represents an alkyl group (including substituted alkyl) having from 1 to 18, and preferably 1 to 4 carbon atoms, such as methyl, ethyl, propyl, isopropyl, butyl, secbutyl, hexyl, dodecyl, octadecyl, benzyl, β-phenylethyl, sulfoalkyl such as β-sulfoethyl, γ-sulfopropyl, β-sulfobutyl, δ-sulfobutyl, etc.; carboxyalkyl such as β-carboxyethyl, γ-carboxypropyl, γ-carboxybutyl, etc.; sulfatoalkyl such as γ-sulfatopropyl and δ-sulfatobutyl, etc., or an alkylene chain which joins with a methine linkage, such as a butylene or neopentylene linkage, or an aryl group such as phenyl, naphthyl, tolyl, p-chlorophenyl, etc. $R_3$ and $R_4$ when taken together can also form a 5 or 6 membered heterocyclic ring. It will be noted that in some instances, the acid anion, represented by X in the above formula, is included in the substituent represented by $R_1$ $R_2$, such as dyes containing the betaine type structure. Each L represents a methine group (e.g., —CH=, —C(CH$_3$)=, etc.), and $Z_1$, and $Z_2$ each represents the non-metallic atoms necessary to complete a heterocyclic nucleus of the type used in cyanine dyes containing from 5 to 6 atoms in the heterocyclic ring, e.g., thiazole, 4-phenylthiazole, 4,5-diphenylthiazole, 4-(2-thienyl)thiazole, 4-methylthiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzothiazole, 5-methoxybenzothiazole, 5-ethoxybenzothiazole, 5-phenylbenzothiazole, 6-chlorobenzothiazole, 6-bromobenzothiazole, 6-methylbenzothiazole, 6-methoxybenzothiazole, 6-ethoxybenzothiazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 1,3-dialkyl, 1,3-diaryl or 1-alkyl-3-aryl, imidazoles and benzimidazoles, such as 5-chloro-1,3-dialkyl benzimidazoles, 5-chloro-1,3-diaryl benzimidazoles, 5,6-dichloro-1,3-dialkyl benzimidazoles, 5,6-dichloro-1,3-diaryl benzimidazoles, 5-methoxy-1,3-dialkyl benzimidazoles, 5-methoxy-1,3-diaryl benzimidazoles, 5-cyano-1,3-dialkyl benzimidazoles, 5-cyano-1,3-diaryl benzimidazoles, 1,3-dialkylnaphth[1,2-d]imidazole, 1,3-diaryl-naphth[2,1-d]imidazole, 4-methylselenazole, 4-phenylselenazole, selenazole, benzoselenazole, 5-chlorobenzoselenazole, α-naphthothiazole, β-naphthothiazole, 2- and 4-quinolines e.g., 6-methyl-2-quinoline, 6-methoxy-4-quinoline, 6-ethoxy-2-quinoline, 6-chloro-4-quinoline, 4-methoxy-2-quinoline, 4-methoxy-2-quinoline, 4-methyl-2-quinoline, 8-methoxy-4-quinoline, 3,3-dimethylindolenine, etc.; Q represents the atoms necessary to complete an ethylene linkage which can be substituted with one, two or more suitable groups, such as an alkyl group having 1 to 4 carbon atoms such as methyl, ethyl, propyl, isopropyl and butyl, a halogen atom such as chlorine or bromine, or an alkoxy group having 1 to 4 carbon atoms, such as methoxy, ethoxy, propoxy, isopropoxy, butoxy, etc. and G represents an alkylene bridge such as the atoms necessary to complete a cyclohexene ring.

Typical useful infrared spectral sensitizing dyes are described, for example, in Trivelli et al U.S. pat. No. 2,245,236, issued June 10, 1941, Brooker U.S. Pat. Nos. 2,095,854 and 2,095,856 issued Oct. 12, 1937, Dieterle U.S. Pat. No. 2,084,436, issued June 22, 1937, Zeh U.S. Pat. No. 2,104,064, issued Jan. 4, 1938, Konig U.S. Pat. No. 2,199,542, issued May 7, 1940, Brooker et al U.S. Pat. No. 2,213,238, issued Sept. 3, 1940, Heseltine U.S. Pat. Nos. 2,734,900 and 3,582,344, issued Feb. 14, 1956 and June 1, 1971, respectively, Barth et al. U.S. Pat. No. 2,134,546, issued Oct. 25, 1938, Brooker U.S. Pat. No. 2,186,624, issued Jan. 9, 1940, Schneider U.S. Pat. No. 2,073,759, issued Mar. 16, 1937, Thompson U.S. Pat. No. 2,611,695, issued Sept. 23, 1952, Brooker et al U.S. Pat. No. 2,955,939, issued Oct. 11, 1960, Jenkins et al U.S. Pat. No. 3,573,921, issued Apr. 6, 1971, Jeffreys U.S. Pat. No. 3,552,974, issued Jan. 5, 1971, and Fumia et al. U.S. Pat. Nos. 3,482,978, 3,623,881 and 3,652,288, issued Dec. 9, 1969, Nov. 30, 1971 and Mar. 28, 1972, respectively.

Especially advantageous infrared sensitizing dyes according to this invention are the 4,4'-carbocyanines, thiadicarbocyanines, selenadicarbocyanines, this-2'-dicarbocyanines, dibenzothiadicarbocyanines, thiatricarbocyanines, selenatricarbocyanines, merodicarbocyanines, oxatricarbocyanines, dibenzooxadicarbocyanines, thiazolotricarbocyanines, thiazolinotricarbocyanines, 2,2'-dicarbocyanines, 4,4'-dicarbocyanines, 2,2'-tricarbocyanines, 4,4'-tricarbocyanines, indotricarbocyanines, merotricarbocyanines, alkylene-bridged tri-, tetra-, and pentacarbocyanines, pentamethineoxonols, long-chain, infrared-sensitizing complex cyanines (rhodacyanines) and allopolarcyanines, and enamine-derived tricarbocyanines and hexamethine hemicyanines, If desired, combinations of infrared spectral sensitizing dyes as well as the use of other spectral sensitizers in combination with the infrared sensitizers can be employed in the practice of the invention.

In accordance with this invention, the photographic infrared sensitizing dyes are employed in concentrations which would normally cause at least 0.3 log E desensitization in the surface-sensitive emulsion in which the dye is incorporated. The amount of dye which will cause 0.3 log E desensitization can be determined by adding various amounts of dye to a test portion of the emulsion, coating the emulsion on a support, sensitometrically exposing the emulsion to light to which the silver halide is intrinsically sensitive, e.g. 380—440 nm., and developing in a suitable developing solution such as, for example, for 6 minutes at 20° C. in Kodak D-19 developer of the combination:

| | G |
|---|---|
| N-methyl-p-aminophenol sulfate | 2.0 |
| Sodium sulfite, desiccated | 90.0 |
| Hydroquinone | 8.0 |
| Sodium carbonate, monohydrated | 52.2 |
| Potassium bromide | 5.0 |
| Water to 1 liter | |

For dyes which typically extend spectral sensitivity to infrared radiation, optimum concentrations have previously been about 3 to 50 mg. of dye per mole of silver halide. High concentrations, such as 100 to 800 mg. per mole of silver, of dyes of this type have previously caused at least more than 0.3 log E desensitization. The infrared sensitizers generally have $E_c$ values more positive than −1.2, such as −.2 to −1.2, and $E_a$ values more negative than about +.6, such as between about +.2 to +.6 volts. Infrared sensitizers sensitize silver halide to radiation longer than about 700 nm. These dyes can be effectively used at the higher concentrations of from about 50 to 1000 mg. and preferably from about 100 to 800 mg. per mole of silver in accordance with this invention without causing desensitization.

The azaindence-silver complexes can be formed in low pAg surface-sensitive emulsions to reduce the desensitization caused by high concentrations of photographic sensitizing dyes as well as to eliminate the fog and instability problems associated with low pAg emulsions. The most useful organic silver complexes are complexes of silver with an azaindene, such as a triazaindence, a tetraazaindene or a pentaazaindene. Any azaindene compound which forms a silver salt with a solubility product between that of silver chloride ($1.6 \times 10^{-10}$ at 25° C) and silver bromide ($7.7 \times 10^{-13}$ at 25° C) can be used according to this invention. Hydroxy and amino substituted azaindenes are especially useful. Representative useful azaindenes include those described in the following references: Allen et al. U.S. Pat. No. 2,735,769, Feb. 21, 1956, Allen et al. U.S. Pat. No. 2,743,181, Apr. 24, 1956, Tinker et al. U.S. Pat. No. 2,835,581, May 20, 1958, Reynolds U.S. Pat. No. 2,756,147, July 24, 1956, Carroll et al. U.S. Pat. No. 2,743,180, Apr. 24, 1956, Zeitschrift fur Wiss. Phot. 47,2–28 (1952), Carroll et al. U.S. Pat. No. 2,716,062, Aug. 23, 1955, Allen et al. U.S. Pat. No. 2,772,164, Nov. 27, 1956, Allen et al. U.S. Pat. No. 2,713,541, July 16, 1955, Tinker U.S. Pat. No. 2,852,375, Sept. 16, 1958, Carroll U.S. Pat. No. 2,743,180, Apr. 24, 1956, Fry U.S. Pat. No. 2,566,658 Sept. 4, 1951, Heimbach et al. U.S. Pat. No. 2,444,605–7, July 6, 1948, Heimbach et al. U.S. Pat. No. 2,449,225–6, Sept. 14, 1948. Especially useful tetraazaindenes include those having the following formula:

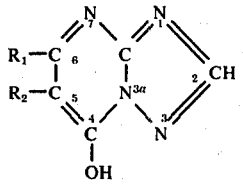

in which $R_1$ is an alkyl group, e.g., methyl, ethyl, propyl, butyl, etc. $R_2$ is hydrogen, a halogen, e.g., chloride, bromide, iodide, an alkyl group, e.g. methyl, ethyl, etc., an alkoxy group, e.g. methoxy, ethoxy, etc. Some particularly useful azaindenes are listed below:

4-hydroxy-6-methyl-1,3,3a,7-tetraazaindene, 4-hydroxy-2-β-hydroxy-ethyl-6-methyl-1,3,3a,7-tetraazaindene, 5-carbethoxy-4-hydroxy-1,3,3a,7-tetraazaindene, 7-hydroxy-1,2,3,4,6-pentaazaindene, 2,4-dihydroxy-6-methyl-1,3a,7-triazaindene, 4-hydroxy-2-γ-hydroxypropyl-6-methyl-1,3,3a,7-tetraazaindene, 4-hydroxy-2(4-pyridyl)-6-methyl-1,3,3a,7-tetraazaindene, 4-hydroxy-6-methyl-1,2,3,3a,7-pentazaindene, 5-amino-2(p-carboxyphenyl)-7-hydroxy-1,3,4,6-pentaazaindene, 2,4-dihydroxy-6-dihydroxy-6-methyl-1,3a,7-triazaindene, 2,5-dimethyl-7-hydroxy-1,4,7a-triazaindene, 5-amino-7-hydroxy-2-methyl-1,4,7a-triazaindene, 5-carboxy-4-hydroxy-1,3,3a,7-tetraazaindene, 1,2-bis(4-hydroxy-6-methyl-1,3,3a,7-tetraazaindene-5-yl)ethane, 2-amino-5-carboxy-4-hydroxy-1,3,3a,7-tetraazaindene.

The azaindene silver complexing compound is added to the emulsion in an amount sufficient to effectively reduce desensitization caused by the higher concentration of spectral sensitizing dye. The actual amount added depends primarily on the specific spectral sensitizing dye or dyes being used and the pAg of the emulsion. The most useful results are obtained when the silver complex is formed in a sufficient concentration in an emulsion with the pAg adjusted to from about 6.0 to 8.5 and preferably from about 6.5 to 7.5 with silver nitrate. (Note that pAg values given herein are determined at 40° C.). In addition to reducing the desensitization caused by the high concentration of dye, the azaindene-silver complexes employed in this invention overcome the intolerable fog and instability which typically results when the pAg of the emulsion is lowered with silver nitrate.

In view of the unique method of sensitizing an infrared sensitive silver halide surface-sensitive emulsion with a potentially desensitizing concentration of dye, the concentration of dye and azaindene as well as the optimum pAg must be determined for each sensitizing dye. Useful concentrations of infrared sensitizing dye of from about 50 mg. to 1000 mg. can be used while concentrations of from about 100 mg. to 800 mg. are preferred. The dye and azaindene can be incorporated in the silver halide emulsions at a temperature ranging from about 40° C. to 60° C. It is preferred that the azaindene-silver complex be formed in the emulsion prior to coating on a suitable support.

However, if desired, a gel layer having imbibed therein an ethanol solution of the silver complex, can be brought into contact with a coating containing a higher concentration of a potential desensitizing dye; the laminated element is then exposed, separated and processed in a typical photographic developer. Substantial speed gains can be obtained by this method. Prompt exposure and development are not required when the silver-azaindene complexes are utilized.

The process of this invention is useful in spectrally sensitizing into the infrared any of the photographic silver halide emulsions, including silver bromide, silver chloride, silver bromoiodide, silver chlorobromide, silver chloroiodide or silver chlorobromoiodide. The photographic grains can be dispersed in any suitable binder, including such hydrophilic binders as gelatin, albumin, agar-agar, gum arabic, alginic acid, polyvinyl alcohol, polyvinyl pyrrolidone, cellulose esters, partially hydrolyzed cellulose acetate, and the like. The binding agents for the emulsion layer of the photographic element can also contain dispersed polymerized vinyl compounds. Such compounds are disclosed, for example, in U.S. Pat. No. 3,142,568; 3,193,386; 3,062,674 and 3,220,844 and include the water-insoluble polymers of alkyl acrylates and methacrylates, acrylic acid, sulfoalkyl acrylates or methacrylates and the like.

Emulsions sensitized as described herein can be coated on any suitable photographic support, such as glass, film base such as cellulose acetate, cellulose acetate butyrate, polyesters such as poly(ethylene terephthalate), paper, baryta coated paper, polyolefin coated paper, e.g., polyethylene or polypropylene coated paper, which may be electron bombarded to promote emulsion adhesion, to produce the novel photographic elements of the invention.

Emulsions sensitized in accordance with this invention can contain addenda such as chemical sensitizers, e.g., sulfur sensitizers (e.g., allyl thiocarbamate, thiourea, allylisothiocyanate, cystine, etc.) various gold compounds (e.g., potassium chloroaurate, auric trichloride, etc. (see Baldsiefen U.S. Pat. No. 2,540,085, issued Feb. 6, 1951; Damschroder U.S. Pat. No. 2,597,856, issued May 27, 1952 and Yutzy et al. U.S. Pat. No. 2,597,915, issued May 27, 1952), various palladium compounds such as palladium chloride (Baldsiefen U.S. Pat. No. 2,540,086 issued Feb. 6, 1951), potassium chloropalladate (Stauffer et al. U.S. Pat. No. 2,598,079, issued May 27, 1952), etc., or mixtures of such sensitizers; antifoggants such as ammonium chloropalladate (Trivelli et al. U.S. Pat. 2,566,245, issued Aug. 28, 1951), ammonium chloroplatinite (Trivelli et al. U.S. Pat. No. 2,566,263, issued Aug. 28, 1951), benzotriazole, nitrobenzimidazole, 5-nitroimidazole, benzidine, mercaptans, etc. (see Mees and James, *The Theory of the Photographic Process*, MacMillan Publishers, 1942, page 460), or mixtures thereof. The silver halide emulsions of the invention can be hardened with any suitable hardener, including aldehyde hardeners such as formaldehyde, and mucochloric acid, aziridine hardeners, hardeners which are derivatives of dioxane, oxypolysaccharides such as oxy starch or oxy plant gums, vinyl sulfonyl ethers, and the like. The emulsion layers can also contain additional additives, particularly those known to be beneficial in photographic emulsions, including, for example, lubricating materials, stabilizers, speed-increasing materials, absorbing dyes, plasticizers, and the like. These photographic emulsions can also contain additional spectral sensitizing dyes. Furthermore, these emulsions can contain color-forming couplers or can be developed in solutions containing couplers or other color-generating materials. Among the useful color-formers are the monomeric and polymeric color-formers, e.g., pyrazolone color-formers, as well as phenolic, heterocyclic and open-chain couplers having a reactive methylene group. The color-forming couplers can be incorporated into the photographic silver halide emulsion using any suitable technique, e.g., techniques of the type shown in Jelley et al U.S. Pat. No. 2,322,027, issued June 15, 1943, Fierke et al U.S. Pat. No. 2,801,171, issued July 30, 1957, Fisher U.S. Pat. No. 1,055,155 and 1,102,028, issued Mar. 4, 1913 and June 30, 1914, respectively, and Wilmanns U.S. Pat. No. 2,186,849, issued Jan. 9, 1949. They can also be developed using incorporated developers such as polyhydroxybenzenes, aminophenols, 3-pyrazolidones, and the like.

References to various photographic addenda have been published in Produce Licensing Index Vol. 92, Dec. 1971, publication 9232, pages 107–110. Paragraphs, V, VI, VII, VIII, IX, XI, XII, XIII, XIV and XXII of this publication are incorporated herein by reference.

The following examples are included for a further understanding of this invention.

EXAMPLE 1

A surface-sensitive, spectrally sensitized control coating is prepared as follows. To a sulfur and gold sensitized gelatino-silver bromoiodide cubic-grained emulsion containing 2.5 mole percent iodide is added the combination of sensitizing dyes, 3,3'-diethylselenadicarbocyanine iodide (infrared sensitizer) at 112 mg. per mole of silver, 3-ethyl-5-(3-piperidinoallylidene)rhodanine at 88 mg. per mole of silver, 3,3'-diethyl-9-methylselenacarbocyanine iodide at 22 mg. per mole of silver. The liquid emulsion is held for 15 minutes at 40° C with a resultant pAg of 8.7. The emulsion is combined with a surfactant and a hardener and coated on a gelatin subbed polyethylene terephthalate support at 0.004 inch. The dried coating is exposed in a wedge spectrograph for 1/100 second to a tungsten light source through a Kodak Wratten 25 (red and infrared transmitting) filter and developed in Kodak D-19 developer at 20° C for 6 minutes. The element is assigned a relative infrared speed (beyond 700 nm.) of 100 and has a fog level of 0.02. After incubation for 7 days at 49° C and 50% relative humidity the relative speed is 43 and the fog level 0.02.

EXAMPLES 2–4

Three elements are prepared as in Example 1 with the following exceptions. In Example 2, the azaindene 4-hydroxy-6-methyl-1,3,3a,7-tetraazaindene is added to the emulsion. In Example 3 the pAg of the emulsion of Example 1 is adjusted to 7.0 with dilute (0.1 N) silver nitrate. In Example 4, the emulsion containing the azaindene of Example 2 is adjusted to pAg 7.0 as in Example 3. The elements are exposed and processed as in Example 1 with the results listed in Table 1.

Table 1

| Example | Azaindene (g/mole AG) | pAg | Tests-fresh Relative Speed | Tests-fresh Fog | Tests-incubated Relative Speed | Tests-incubated Fog |
|---|---|---|---|---|---|---|
| 2 | 1.8 | 8.7 | 245 | .02 | 102 | .02 |
| 3 | 0 | 7.0 | 282 | .10 | 89 | .35 |
| 4 | 1.8 | 7.0 | 910 | .07 | 380 | .19 |

Example 2 shows some increase in speed when the emulsion containing the azaindene is at a pAg of 8.7. Example 3 shows the well known effect of a speed increase with lowered pAg but with an increase in fog in the fresh emulsion and a very high fog level in the incubated emulsion. Example 4 shows the synergistic effect of the azaindene at the low pAg (7.0) wherein substantial speed increases and acceptable fog levels are obtained in both the fresh and incubated emulsions.

EXAMPLES 5 and 6

Two elements are prepared and processed as in Example 1 except that only the infrared sensitizing dye - 3,3'-diethylselenadicarbocyanine iodide is used to sensitize the emulsion. In addition, the emulsion of Example 6 has an adjusted pAg of 7.0 and contains the azaindene 4-hydroxy-6-methyl-1,3,3-a,7-tetraazaindene. Table 2 lists the results.

Table 2

| Example | pAg | Tests-fresh Relative Speed | Tests-fresh Fog | Tests-incubated Relative Speed | Tests-incubated Fog |
|---|---|---|---|---|---|
| 5 | 8.7 | 100 | .02 | 58 | .01 |
| 6 | 7.0 | 740 | .03 | 436 | .02 |

EXAMPLES 7–10

Four elements are prepared and processed as in Example 1 except that the pAg of the emulsions are adjusted to 8.8, 8.4, 8.0 and 7.2 and the dyes, 3,3'-diethylselenadicarbocyanine iodide (infrared sensitizer) at 228 mg. per mole of silver and 1',3-diethyl-4-phenyloxazole-2'-cyanine iodide at 42 mg. per mole of silver are used. All four elements contain 1.8 grams per mole of silver of the azaindene of Example 2. The results are listed in Table 3.

Table 3

| Example | pAg | Tests-fresh Relative Speed | Tests-fresh Fog | Tests-incubated Relative Speed | Tests-incubated Fog |
|---|---|---|---|---|---|
| 7 | 8.8 | 100 | .06 | 73 | .06 |

Table 3-continued

| Example | pAg | Tests-fresh Relative Speed | Tests-fresh Fog | Tests-incubated Relative Speed | Tests-incubated Fog |
|---|---|---|---|---|---|
| 8 | 8.4 | 151 | .06 | 120 | .07 |
| 9 | 8.0 | 209 | .06 | 209 | .07 |
| 10 | 7.2 | 330 | .06 | 362 | .08 |

EXAMPLES 11–15

Elements are prepared and processed as in Example 2 at a pAg of 7.0 except that the azaindene 4-hydroxy-6-methyl-1,3, 3a,7-tetraazaindene is replaced with the following silver complexing azaindenes

| Example | Azaindene 1.8 g/mole Ag |
|---|---|
| 11 | 4-hydroxy-2-β-hydroxy-ethyl-6-methyl-1,3,3a, 7-tetraazaindene |
| 12 | 5-carbethoxy-4-hydroxy-1,3,3a,7-tetraazaindene |
| 13 | 7-hydroxy-1,2,3,4,6-pentaazaindene |
| 14 | 2,4-dihydroxy-6-methyl-1,3a,7-triazaindene |

In all examples the fresh and incubated tests result in high relative speed and low-fog levels.

The invention has been described in detail with particular reference to preferred embodiments thereof, but, it will be understood that variations and modifications can be effected within the spirit and scope of the invention.

We claim:

1. A surface-sensitive photographic silver halide emulsion having a pAg of about 6.0 to 8.5, said emulsion containing a. at least one photographic infrared spectral sensitizing dye capable of sensitizing said silver halide emulsion to radiation longer than about 700 nm, said dye being a methine dye having a polarographic cathodic halfwave potential more positive than about −1.20 volts and a polarographic anoidic halfwave potential more negative than about +0.6 volts, said dye being employed in said emulsion at a concentration which results in at least about 0.3 log E desensitization of a test portion of said emulsion, when said test portion of said emulsion is coated on a support and sensitometrically exposed to light to which said silver halide emulsion is intrinsically sensitive and developed for 6 minutes at 20° C in Kodak D-19 developer; and b. a silver complexing axaindene which forms a silver salt with a solubility product between that of silver chloride ($1.6 \times 10^{-10}$ at 25° C) and silver bromide ($7.7 \times 10^{-13}$ at 25° C) in an amount effective to reduce the desensitization caused by said dye.

2. A surface-sensitive photographic silver halide emulsion having a pAg of about 6.0 to 8.5, said emulsion containing a. at least one photographic infrared spectral sensitizing methine dye capable of sensitizing said silver halide emulsion to radiation longer than about 700 nm, said dye being a methine dye having a polarographic cathodic halfwave potential more positive than about −1.20 volts and a polarographic anodic halfwave potential more negative than about +0.6 volts, said dye being employed in said emulsion at a concentration which results in at least about 0.3 log E desensitization of a test portion of said emulsion, when said test portion of said emulsion is coated on a support and sensitometrically exposed to light to which said silver halide emulsion is intrinsically sensitive and developed for 6 minutes at 20° C in Kodak D-19 developer; and b. a silver complexing azaindene which forms a silver salt with a solubility produce between that of silver chloride ($1.6 \times 10^{-10}$ at 25° C) and a silver bromide ($7.7 \times 10^{-13}$ at 25° C) selected from the group consisting of triazaindenes, tetraazaindenes and pentaazaindenes and said complex being present in an amount effective to reduce the desensitization caused by said dye.

3. A surface-sensitive photographic silver halide emulsion having a pAg of about 6.0 to 8.5, said emulsion containing a. at least one photographic infrared spectral sensitizing dye having one of the following formulas:

I.

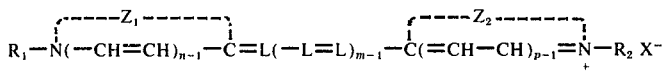

II.

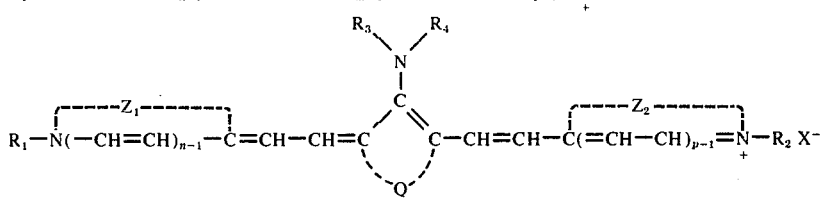

III.

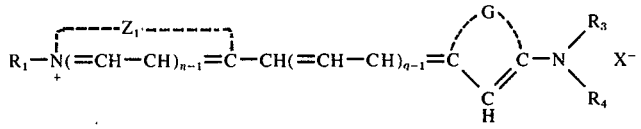

wherein $n$ and $p$ each represent a positive integer of 1 or 2, $m$ represents a positive integer of from 2 to 6, $q$ represents a positive integer of 2 or 3, $X^-$ represents an acid anion, $R_1$, $R_2$, $R_3$ and $R_4$ each represents a member selected from the group consisting of an alkyl group, a sulfoalkyl group, a carboxyalkyl group, a sulfatoalkyl group or an aryl group and $R_3$ and $R_4$ when taken together can represent a 5 or 6 membered heterocyclic ring; L represents a methine group, $Z_1$, and $Z_2$ each represents the non-metallic atoms necessary to complete a 5 to 6 atom heterocyclic nucleus of the type used in cyanine dyes, Q represents the atoms necessary to complete an ethylene linkage and G represents the atoms necessary to complete a cyclohexane ring said dye being employed in said emulsion at a concentration which results in at least about 0.3 log E desensitization of a test portion of said emulsion, when said test portion of said emulsion is coated on a support and sensitometrically exposed to light to which said silver halide emulsion is intrinsically sensitive and developed for 6 minutes at 20° C in Kodak D-19 developer; and b. a silver complexing azaindene which forms a silver salt with a solubility product between that of silver chloride ($1.6 \times 10^{-10}$ at 25° C) and silver bromide ($7.7 \times 10^{-13}$ at 25° C) in an amount effective to reduce the desensitization caused by said dye.

4. The photographic emulsion defined in claim 3 wherein the pAg of the emulsion is from about 6.5 to 7.5.

5. The photographic emulsion defined in claim 3 wherein the infrared dye has a cathodic polarographic halfwave potential between about −.2 to −1.2. volts.

6. The photographic emulsion defined in claim 3 wherein the dye is selected from the group consisting of 4,4′-carbocyanines, thiadicarbocyanines, selenadicarbocyanines, thia-2′-dicarbocyanines, dibenzothiadicarbocyanines, thiatricarbocyanines, selenatricarbocyanines, merodicarbocyanines, oxatricarbocyanines, dibenzooxadicarbocyanines, thiazolotriacarbocyanines, thiazolinotricarbocyanines, 2,2′-dicarbocyanines, 4,4′-dicarbocyanines, 2,2′-tricarbocyanines, 4,4′-tricarbocyanines, indotricarbocyanines, merotricarbocyanines, alkylene-bridged tri-, tetra-, and pentacarbocyanines, pentamethineoxonols, long-chain, infrared-sensitizing complex cyanines (rhodacyanines) and allopolarcyanines, and enamine-derived tricarbocyanines and hexamethine hemicyanines.

7. The photographic emulsion defined in claim 3 wherein the azaindene is selected from the group consisting of 4-hydroxy-6-methyl-1,3,3a,7-tetraazaindene, 4-hydroxy-2-β-hydroxy-ethyl-6-methyl-1,3,3a,7-tetraazaindene, 5-carbethoxy-4-hydroxy-1,3,3a,7-tetraazaindene, 7-hydroxy-1,2,3,4,6-pentaazaindene, 2,4-dihydroxy-6-methyl-1,3a,7-triazaindene, 4-hydroxy-2-γ-hydroxypropyl-6-methyl-1,3,3a,7-tetraazaindene, 4-hydroxy-2(4-pyridyl)-6-methyl-1,3,3a,7-tetraazaindene, 4-hydroxy-6-methyl-1,2,3,3a,7-pentaazaindene, 5-amino-2(p-carboxyphenyl)-7-hydroxy-1,3,4,6-pentaazaindene, 2,4-dihydroxy-6-methyl-1,3a, 7-triazaindene, 2,5-dimethyl-7-hydroxy-1,4,7a-triazaindene, 5-amino-7-hydroxy-2-methyl-1,4,7a-triazaindene, 5-carboxy-4-hydroxy-1,3,3a,7-tetraazaindene, 1,2-bis(4-hydroxy-6-methyl-1, 3,3a,7-tetraazaindene-5-yl)ethane and 2-amino-5-carboxy-4-hydroxy-1,3,3a,7-tetraazaindene.

8. A surface-sensitive photographic silver halide emulsion having a pAg of about 6.0 to 8.5, said emulsion containing a. at least one photographic infrared spectral sensitizing dye capable of sensitizing said silver halide emulsion to radiation longer than about 700 mn, said dye being a methine dye having a polarographic cathodic halfwave potential more positive than about −1.20 volts and a polarographic anodic halfwave potential more negative than about +0.6 volts, said dye being employed in said emulsion at a concentration which results in at least about 0.3 log E desensitization of a test portion of said emulsion, when said test portion of said emulsion is coated on a support and sensitometrically exposed to light to which said silver halide emulsion is intrinsically sensitive and developed for 6 minutes at 20° C in Kodak D-19 developer; and b. 4-hydroxy-6-methyl-1,3,3a,7-tetraazaindene in an amount effective to reduce the desensitization caused by the spectral sensitizing dye.

9. A photographic element comprising a support overcoated with a surface sensitive photographic silver halide emulsion having a pAg of about 6.0 to 8.5, said emulsion containing a. at least one photographic infrared spectral sensitizing dye capable of sensitizing said silver halide emulsion to radiation longer than about 700 nm, said dye being a methine dye having a polarographic cathodic halfwave potential more positive than about −1.20 volts and a polarographic anodic halfwave potential more negative than about +0.6 volts, said dye being employed in said emulsion at a concentration which results in at least about 0.3 log E desensitization of a test portion of said emulsion, when said test portion of said emulsion is coated on a support and sensitometrically exposed to light to which said silver halide emulsion is intrinsically sensitive and developed for 6 minutes at 20° C in Kodak D-19 developer; and b. a silver complexing azaindene which forms a silver salt with a solubility produce between that of silver chloride ($1.6 \times 10^{-10}$ at 25° C) and silver bromide ($7.7 \times 10^{-13}$ at 25° C) in an amount effective to reduce the desensitization caused by said dye.

10. The photographic element defined in claim 9 wherein the pAg of the emulsion is from about 6.5 to 7.5.

11. The photographic element defined in claim 9 wherein the dye is selected from the group consisting of 4,4′-carbocyanines, thiadicarbocyanines, selenadicarbocyanines, thia-2′-dicarbocyanines, dibenzothiadicarbocyanines, thiatricarbocyanines, selenatricarbocyanines, merodicarbocyanines, oxatricarbocyanines, dibenzooxadicarbocyanines, thiazolotricarbocyanines, thiazolinotricarbocyanines, 2,2′-dicarbocyanines, 4,4′-dicarbocyanines, 2,2′-tricarbocyanines, 4,4′-tricarbocyanines, indotricarbocyanines, merotricarbocyanines, alkylene-bridged tri-, tetra-, and pentacarbocyanines, pentamethineoxonols, long-chain, infrared-sensitizing complex cyanines (rhodacyanines) and allopolarcyanines, and enamine-derived tricarbocyanines and hexamethine hemicyanines.

12. The photographic element defined in claim 9 wherein the azaindene is selected from the group consisting of 4-hydroxy-6-methyl-1,3,3a,7-tetraazaindene, 4-hydroxy-2-β-hydroxy-ethyl-6-methyl-1,3,3a,7-tetraazaindene, 5-carbethoxy-4-hydroxy-1,3,3a,7-tetraazaindene, 7-hydroxy-1,2,3,4,6-pentaazaindene, 2,4-dihydroxy-6-methyl-1,3a,7-triazaindene, 4-hydroxy-2-γ-hydroxypropyl-6-methyl-1,3,3a,7-tetraazaindene, 4-hydroxy-2(4-pyridyl)-6-methyl-1,3,3a,7-tetraazaindene, 4-hydroxy-6-methyl-1,2,3,3a,7-pentaazaindene, 5-amino-2-(p-carboxyphenyl)-7-hydroxy-1,3,4,6-pentaazaindene, 2,4-dihydroxy-6-methyl-1,3a, 7-triazaindene, 2,5-dimethyl-7-hydroxy-1,4,7a-triazaindene, 5-amino-7-hydroxy-2-methyl-1,4,7a-triazaindene, 5-carboxy-4-hydroxy-1,3,3a,7-tetraazaindene, 1,2-bis(4-hydroxy-6-methyl-1, 3,3a,7-tetraazaindene-5-yl)ethane, and 2-amino-5-carboxy-4-hydroxy-1,3,3a,7-tetraazaindene.

13. A surface-sensitive photographic silver halide emulsion having a pAg of about 6.0 to 8.5, said emulsion containing a. at least one photographic infrared spectral sensitizing dye having one of the following formulas:

I.

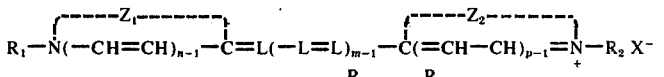

II.

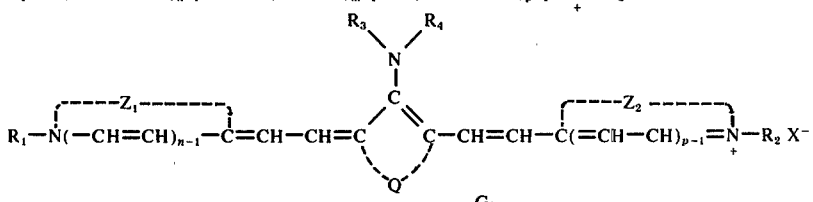

III.

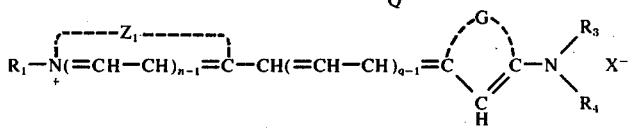

wherein $n$ and $p$ each represent a positive integer of 1 or 2, $m$ represents a positive integer of from 2 to 6, $q$ represents a positive integer of 2 or 3, $X^-$ represents an acid anion, $R_1$, $R_2$, $R_3$ and $R_4$ each represents a member selected from the group consisting of an alkyl group, a sulfoalkyl group, a carboxyalkyl group, a sulfatoalkyl group or an aryl group and $R_3$ and $R_4$ when taken together can represent a 5 or 6 membered heterocyclic ring; L represents a methine group, $Z_1$, and $Z_2$ each represents the non-metallic atoms necessary to complete a 5 to 6 atom heterocyclic nucleus of the type used in cyanine dyes, Q represents the atoms necessary to complete an ethylene linkage and G represents the atoms necessary to complete a cyclohexane ring said dye being employed in said emulsion at a concentration of about 100 mg. to 800 mg. per mole of silver; and b. a silver complexing azaindene which forms a silver salt with a solubility product between that of silver chloride ($1.6 \times 10^{-10}$ at 25° C) and silver bromide ($7.7 \times 10^{-13}$ at 25° C) in an amount effective to reduce the desensitization caused by said dye.

14. A photographic element comprising a support overcoated with a surface sensitive photographic silver halide emulsion having a pAg of about 6.0 to 8.5, said emulsion containing a. at least one photographic infrared spectral sensitizing dye capable of sensitizing said silver halide emulsion to radiation longer than about 700 nm, said dye being a methine dye having a polarographic cathodic halfwave potential more positive than about −1.20 volts and a polarographic anodic halfwave potential more negative than about +0.6 volts, said dye being employed in said emulsion at a concentration of about 100 mg. to 800 mg. per mole of silver; and b. a silver complexing azaindene which forms a silver salt with a solubility product between that of silver chloride ($1.6 \times 10^{-10}$ at 25° C) and silver bromide ($7.7 \times 10^{-13}$ at 25° C) in an amount effective to reduce the desensitization caused by said dye.

* * * * *

UNITED STATES PATENT AND TRADEMARK OFFICE

CERTIFICATE OF CORRECTION

PATENT NO. : 4,011,083
DATED : March 8, 1977
INVENTOR(S) : Maurice F. Durning and John E. Starr It is certified that error appears in the above-identified patent and that said Letters Patent are hereby corrected as shown below:

Column 10, line 52, "axaindene" should read ---azaindene---;

Column 11, line 8, "produce" should read ---product---;

Column 13, line 39, "produce" should read ---product---.

Signed and Sealed this

Sixth Day of September 1977

[SEAL]

*Attest:*

RUTH C. MASON
*Attesting Officer*

LUTRELLE F. PARKER
*Acting Commissioner of Patents and Trademarks*